US006010007A

United States Patent [19]

Moren et al.

[11] Patent Number: 6,010,007

[45] **Date of Patent: *Jan. 4, 2000**

[54] THERMOFORMED FRAGILITY PACKAGING

[75] Inventors: Michael S. Moren, Wheaton, Ill.; Fred Schindler, Santa Cruz, Calif.

[73] Assignees: Plastofilm Industries, Inc., Wheaton, Ill.; Roberts,Stephens, van Amburg Packaging, Inc., Soquel, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/801,846

[22] Filed: Feb. 21, 1997

[51] Int. Cl.[7] ..... B65D 81/05; B65D 85/30; B65D 6/18

[52] U.S. Cl. ..... 206/587; 220/669; 206/586; 206/589; 206/592; 206/564; 206/454

[58] Field of Search ..... 206/591, 592, 206/594, 587, 589, 320, 586, 569, 419, 454, 453; 220/669, 675, 671, 670

[56] References Cited

U.S. PATENT DOCUMENTS

| | | | |
|---|---|---|---|
| 1,958,050 | 5/1934 | Koppelman | 206/592 |
| 2,746,667 | 5/1956 | Murphy . | |
| 2,783,879 | 3/1957 | Emery | 206/594 |
| 2,808,189 | 10/1957 | Williwms | 206/594 |
| 2,863,595 | 12/1958 | Emery | 206/594 |
| 3,266,705 | 8/1966 | Wood | 206/592 |
| 3,305,084 | 2/1967 | Higgins et al. . | |
| 3,502,241 | 3/1970 | Smith . | |
| 3,807,622 | 4/1974 | Belcher et al. . | |
| 3,856,137 | 12/1974 | Brindley . | |
| 4,113,095 | 9/1978 | Dietz et al. | 220/670 |
| 4,658,567 | 4/1987 | Arada | 206/592 |
| 4,736,850 | 4/1988 | Bowman et al. | 206/570 |
| 4,953,705 | 9/1990 | Evamy . | |
| 5,016,751 | 5/1991 | Creaden | 206/587 |
| 5,058,744 | 10/1991 | Creaden | 206/587 |
| 5,199,567 | 4/1993 | Discko, Jr. | 206/369 |
| 5,226,543 | 7/1993 | Foos et al. . | |
| 5,335,770 | 8/1994 | Baker et al. | 206/592 |
| 5,360,109 | 11/1994 | Janota | 206/564 |
| 5,385,232 | 1/1995 | Foos et al. . | |
| 5,450,959 | 9/1995 | Philippi | 206/564 |
| 5,515,976 | 5/1996 | Moren et al. . | |
| 5,611,426 | 3/1997 | Warfield | 206/740 |
| 5,622,262 | 4/1997 | Sadow | 206/522 |
| 5,641,061 | 6/1997 | De Muylder-Braum | 206/564 |
| 5,706,951 | 1/1998 | Oinuma et al. | 206/710 |
| 5,755,329 | 5/1998 | Sadow | 206/522 |
| 5,775,508 | 7/1998 | Bongard et al. | 206/711 |

FOREIGN PATENT DOCUMENTS

| | | | |
|---|---|---|---|
| 1205747 | 2/1960 | France | 206/589 |
| 3010066 | 9/1981 | Germany | 206/586 |
| 9405638 | 6/1994 | Germany . | |
| 596274 | 7/1959 | Italy | 206/589 |
| 870704 | 6/1961 | United Kingdom | 206/589 |

*Primary Examiner*—Paul T. Sewell
*Assistant Examiner*—Anthony Stashick
*Attorney, Agent, or Firm*—Greer, Burns & Crain, Ltd.

[57] ABSTRACT

A unitary fragility packaging article for packaging at least one shock sensitive item within a container having multiple panels, includes in a preferred embodiment a platform portion defining a floor for supporting at least a portion of the item and having a peripheral edge including generally parallel front and rear edges and generally parallel side edges; a plurality of ribs disposed on the platform portion to project from the floor and to divide the floor into a plurality of item-supporting cells; and at least one of the cells being provided with at least a portion of a crush depression for forming a cushion distance between the floor and an adjacent panel of the container.

Other features provided as needed include crush depressions in sidewalls and flaps as well as in the main platform, ribs or cell partitions with controlled rigidity, cell floors with relatively flexible portions defined by troughs, inclined flap cell walls and corresponding tapered cell ribs for easier insertion of fragile items, strengthened upper ends of flap and sidewall cells, structurally strengthened central divider ribs on main platforms and lids, and selective cushioning for the main platform and flaps.

33 Claims, 14 Drawing Sheets

140
150
152
154
156
158
159
160
164
166
167
168
170
172
143
146
H
μ

THERMOFORMED FRAGILITY PACKAGING

BACKGROUND OF THE INVENTION

The present invention relates to packaging for fragile items such as computer components, electronic devices, appliances or the like. More particularly, the present invention relates to an improved thermoformed fragility packaging article which features the ability to be adaptable to packaging a wide variety of fragile items by having regions of a predetermined flexibility or rigidity.

Fragility packaging as used in the present context refers to a type of packaging employing thermoformed plastic structures which provide both structural support and shock absorption to the fragile items they are designed to carry. Such packages are typically used in combination with conventional corrugated cartons, and define shock absorbing air spaces between the packaged item and the inner surfaces of corresponding panels of the carton. Among the many advantages of thermoformed fragility packages are that they are recyclable, provide cushioning against repeated shock loading, are compact to ship and store in bulk, and require relatively smaller cartons than polystyrene foam, perhaps the most widely used type of conventional packaging for such items. Fragility packages are described in commonly assigned U.S. Pat. Nos. 5,226,543; 5,385,232; and U.S. Pat. No. 5,515,976, all of which are incorporated by reference.

One embodiment of the above-described fragility packaging is used for shipping computer components such as disk drives in bulk from manufacturing to assembly points. The distance such packages are designed to travel may vary from one end of a factory to another, to one end of the world to another. Conventional bulk disk drive fragility packages provide a main platform divided into cells for locating and separating each drive relative to the adjacent drive. Generally parallel side edges of the main platform are provided with integrally formed hinged flaps. Preferably, these flaps are also divided into cells which are in registry with the main platform cells, and once placed in a carton, the flaps provide protection to the sides of the drives in each cell. Examples of such packages are manufactured by Plastofirm Industries, Inc. of Wheaton, Ill. and sold by R.S.V.P., Inc., Soquel, Calif. under the trademark U-PAD.

Often, U-PAD packages will be provided with a lid, which is a thermoformed, generally planar panel also provided with cells in registry with the other cells. When the lid is placed over the packaged disks in the U-PAD already in the carton, the tops of the disk drives will also be separated from adjacent disk drives, and the lid will also separate the disk drives from the corresponding top panel or panels of the carton.

U-PAD packages may vary in configuration depending on the size and type of the disk drive or other component being packaged. In some cases, a single row of items will be packaged in separated fashion with a carton, while in others, two rows of items are placed in parallel relationship to each other. In the latter situation, the main platform is provided with an integrally formed, centrally located, vertically projecting sidewall structure. This sidewall structure is also divided into cells to engage the inner sides of each disk drive in each of the two rows of packaged items. In the case of dual row packages, the corresponding lid is also provided with separated, parallel rows of cells to be in registry with the cells of the so-called DOUBLE U-PAD package.

As is the case in the prior art fragility packaging described above, at least the main platform and possibly the flaps and/or lid surfaces of the U-PAD packages are configured to define a separation space or shock absorbing cushion space between the packaged item and the corresponding panel of the carton.

With the increasing popularity of U-PAD packaging, and the corresponding trend in the computer industry to out source components, a wider variety of components and other packaged items are being shipped in this type of package. Also, each manufacturer has its own specifications for the properties which the packaging must have to provide satisfactory protection. Thus, depending on the packaged item and the manufacturer, various regions and/or portions of the fragility package need to have a range of flexibility, rigidity and/or shock absorptive properties For example, packages designed to be carried by hand from one end of a factory to another must be designed to withstand a greater drop height than packages designed to be loaded onto a shipping pallet for transport on a truck.

Another packaging design requirement of component manufacturers is that the packaging be easily installed in the carton and loaded with fragile items by relatively unskilled workers, or even by machine, in as rapid a fashion as possible while still taking into account the inherent fragility of the items.

The packaging manufacturer is then forced to develop many designs of fraility packaging to satisfy customers shipping relatively similar fragile items. As such, to make the most efficient use of resources, the goal of the packaging manufacturer is to provide packaging with a maximum range of properties using as few distinctive package designs as possible.

Accordingly, it is a first object of the present invention to provide an improved fragility packaging article which may be configured to provide a range of flexibility, stiffiess and shock absorbing properties.

It is another object of the present invention to provide an improved fragility packaging article wherein each item-containing cell is provided with its own shock absorbing formations.

Yet another object of the present invention is to provide an improved fragility packaging article wherein each item-containing cell is configured for easy loading of the fragile item.

Still another object of the present invention is to provide an improved fragility packaging article wherein each cell is provided with walls or partitions for maximizing item contact, and with floors having a predetermined resiliency for absorbing shock loading.

A further object of the present invention is to provide an improved fragility package wherein each cell is configured for accommodating fragile items of at least two different sizes.

A still further object of the present invention is to provide an improved fragility packaging article in which a basic structure may be used for the main platform and for the lid.

SUMMARY OF THE INVENTION

The above-identified objects are met or exceeded by the present improved thermoformed fragility packaging article which is provided, in various places, with one or more of several features designed to satisfactorily protect a variety of components and to satisfy a range of packaging specifications. These features include shock absorbing crush depressions in each cell or spanning multiple cells, crush depressions in sidewalls and flaps as well as in the main platform, ribs or cell partitions with controlled rigidity, cell floors with relatively flexible portions defined by troughs, inclined flap cell walls and corresponding tapered cell ribs for easier insertion of fragile items, strengthened upper ends of flap and sidewall cells, structurally strengthened central divider ribs on main platforms and lids, and selective cushioning for the main platform and flaps.

More particularly, the present invention provides a unitary fragility packaging article for packaging at least one shock sensitive item within a container having multiple panels, including a platform portion defining a floor for supporting at least a portion of the item and having a peripheral edge including generally parallel front and rear edges and generally parallel side edges; a plurality of ribs disposed on the platform portion to project from the floor and to divide the floor into a plurality of item-supporting cells; and at least one of the cells being provided with at least a portion of a crush depression for forming a cushion distance between the floor and an adjacent panel of the container.

DETAILED DESCRIPTION OF THE INVENTION

Figure 1:
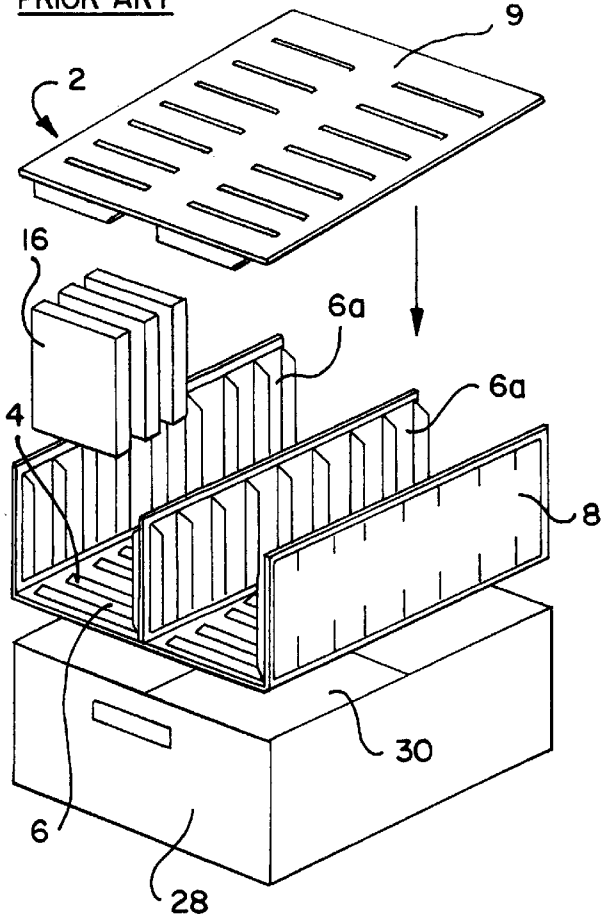
FIG. 1 PRIOR ART
FIG. 1 is an exploded perspective view of a prior art fragility package shown used with a carton.

Referring now to FIG. 1, a prior art fragility package is generally designated 2 and is made of a single sheet of thermoformable material formed into a main platform 4 divided into a plurality of cells 6 for locating and separating each packaged item 16 relative to the adjacent item. Generally parallel side edges of the main platform 4 are provided with integrally formed hinged flaps 8. Preferably, these flaps 8 are also divided into cells 6*a* which are in registry with the main platform cells 6, and once placed in a carton 28, the flaps provide protection to the sides of the items in each cell. It will be appreciated that the carton 28 depicted in FIG. 1 is a conventional six-sided corrugated cardboard carton, however in the illustration the top of the carton has been omitted for clarity. If desired, a fragility lid 9 may be provided to protect the tops of the packaged items 16. This type of fragility package is manufactured by Plastoflim Industries, Inc. of Wheaton, Ill. and sold by R.S.V.P., Inc., Soquel, Calif. under the trademark U-PAD. As described above, a main object of the present invention is to provide enhancements to the original U-PAD style package as illustrated to make it more versatile for a variety of applications, and adaptable to specifications of manufacturers of a wide range of fragile items, including, but not limited to computer components and other fragile electronic devices.

Figure 3:
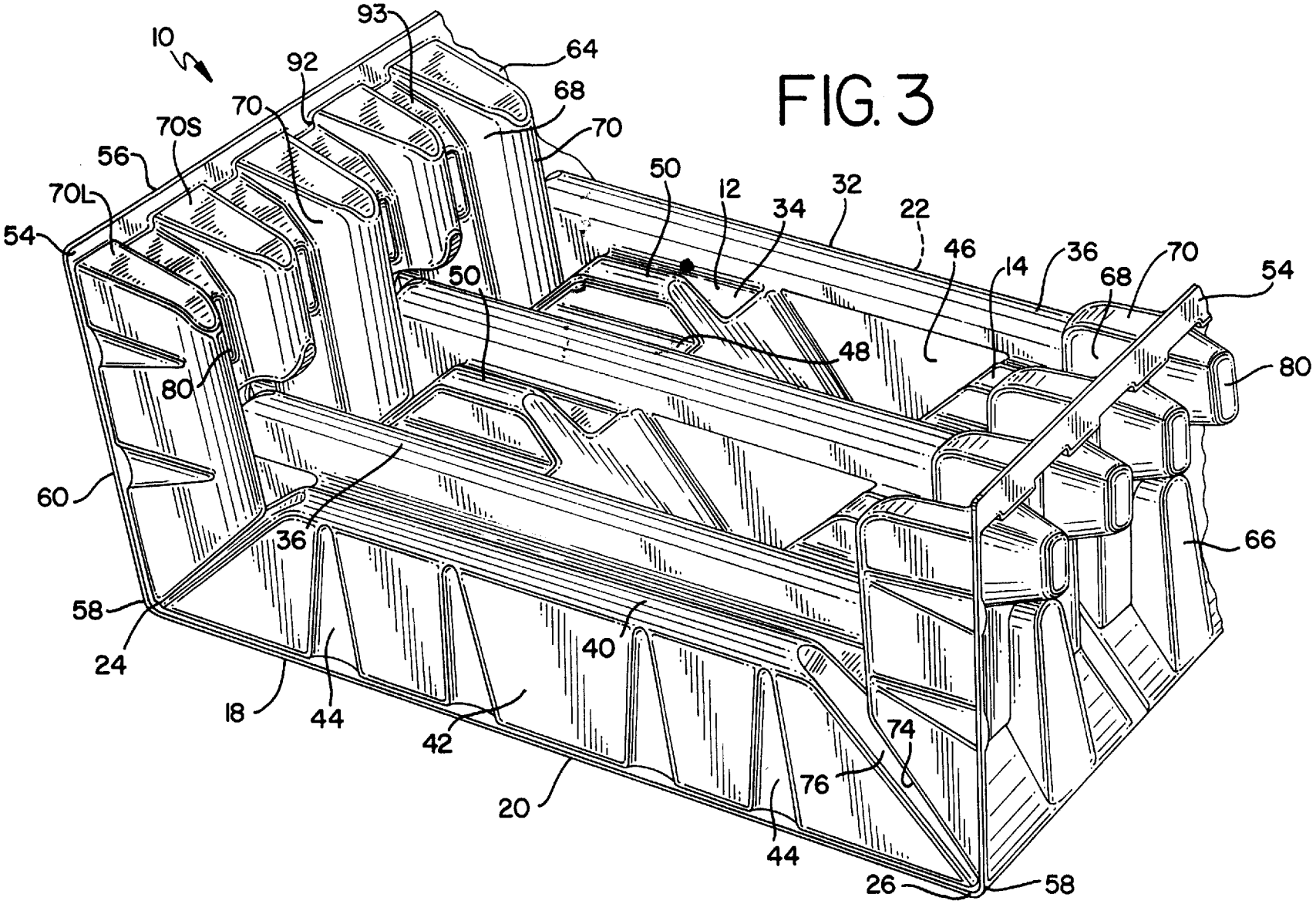
FIG. 3 is a fragmentary top perspective view of a preferred embodiment of the present fragility packaging article.

Referring now to FIG. 3, the preferred embodiment of a unitary fragility packaging article for packaging at least one shock sensitive item within a container having multiple panels, is generally indicated at 10. The article 10 is preferably formed from a single sheet of plastic by thermoforming, injection molding or equivalent technology, with thermoforming being preferred. A preferred material for forming the article 10 is high density polyethylene (HDPE), however other thermoformable polymeric materials may be substituted depending on the application, including the provision of additives for reducing static electricity. HDPE is preferred due to its combination of stiffniess, flexibility and "memory", or its tendency to return to its original shape after shock loading. Sheets of the preferred polymeric material for making the articles 10 preferably have a thickness of about 10 to 90 gauge (mils), however other thicknesses are contemplated depending on the application.

Figure 2:
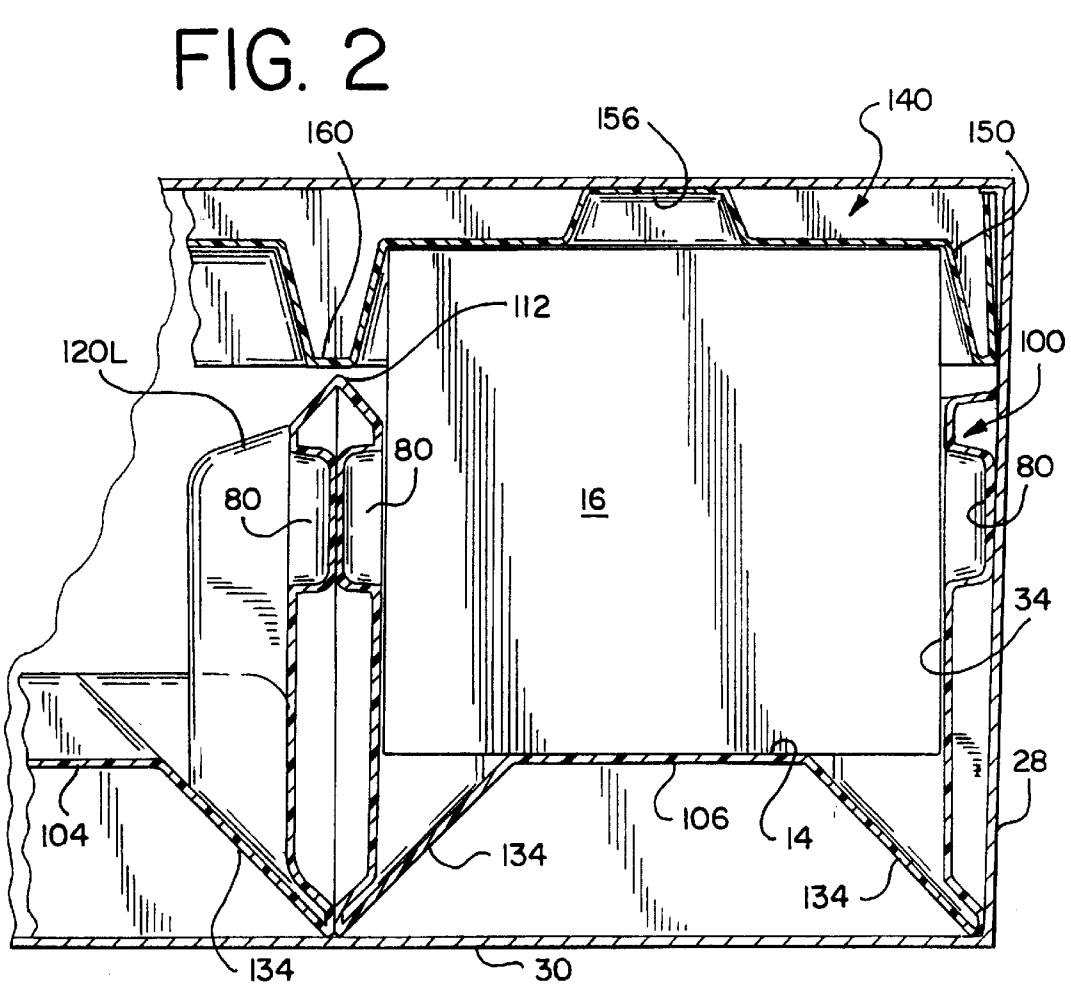
FIG. 2 is a fragmentary front vertical cross-section of an embodiment of the present fragility packaging article shown with a lid and enclosed within a carton.

The article 10 includes a main platform portion 12 defining a floor 14 for supporting at least a portion of the fragile item 16 (best seen in FIGS. 1 and 2). As described above, the fragile article 16 is preferably an electronic component such as a computer disk drive or a printed circuit board, and will in some cases be provided in its own wrapping or packaging, depending on the application. Naturally, other types of fragile articles are contemplated for use with the article 10.

A peripheral edge 18 of the article 10 includes generally parallel front and rear edges 20, 22 (best seen in FIG. 7), respectively and generally parallel side edges 24, 26. It will be understood that the terms "front", "rear" and "side" are used only for the purposes of describing the illustrated embodiment, and that the actual article 10 may be oriented in any position suitable for protecting packaged items. For example, the preferred article 10 is designed to be placed in a corrugated carton 28 (best seen in FIG. 1) with the main platform portion 12 corresponding to a bottom panel 30 of the carton. However, it is contemplated that the article 10 could be placed in the carton 28 in another orientation and still achieve the advantages of the invention.

In addition, it is contemplated that the present packaging article 10 and its alternate embodiments may be provided in varying lengths depending on the particular application and the dimensions of the corresponding carton. As such, the articles have been shown fragmentarily, however, when provided in longer lengths, the same structures as illustrated are repeated.

Figure 6:
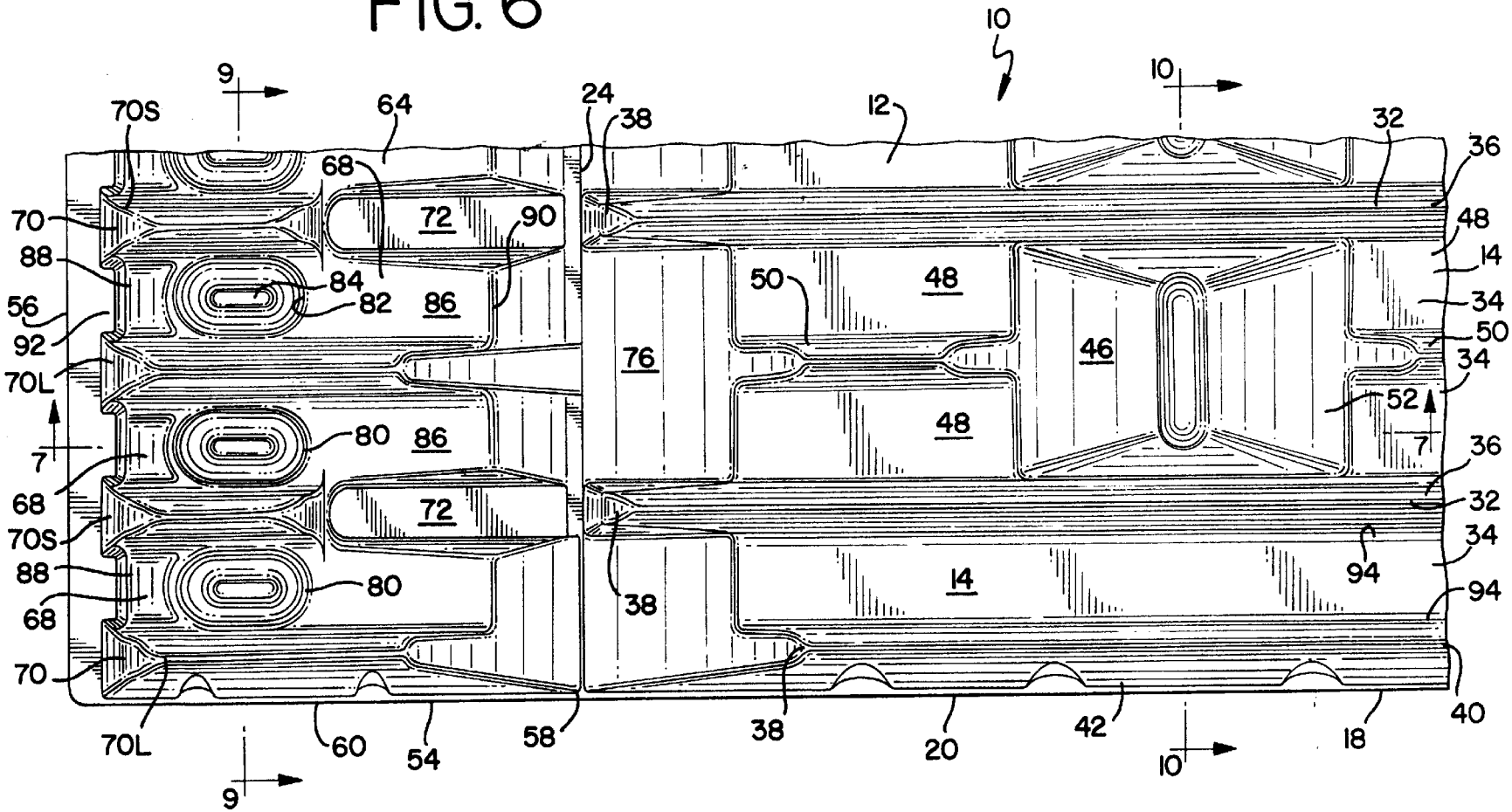
FIG. 6 is a fragmentary overhead plan view of the packaging article shown in FIG. 3.

Referring now to FIGS. 3 and 6, a plurality of ribs 32 are disposed on the platform portion 12 to project generally vertically from the floor 14 and to divide the floor into a plurality of item-supporting cells 34. The ribs 32 are preferably integrally formed with the article 10 and have radiused upper edges 36 and corners 38.

Figure 10:
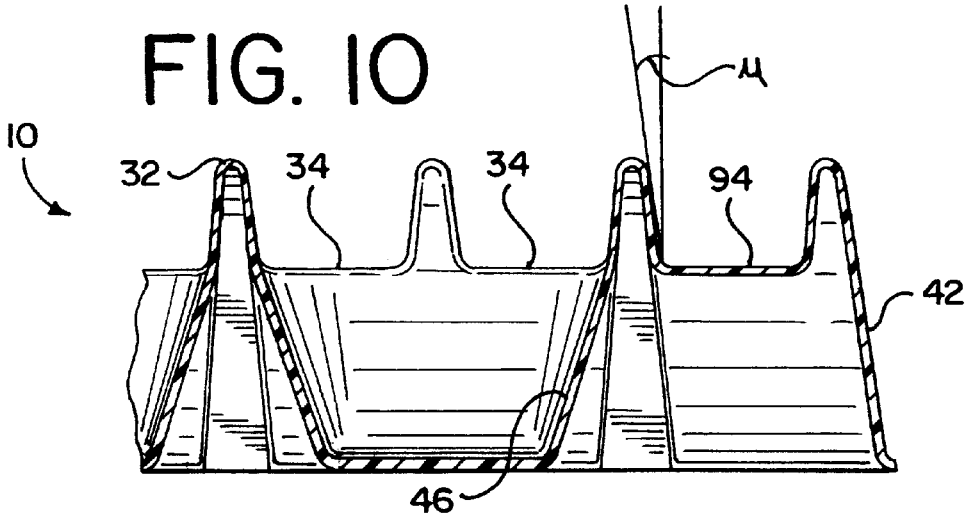
FIG. 10 is a sectional view taken along the line 10—10 of FIG. 6 and in the direction generally indicated.

The ribs 32 function to separate the packaged items 16 from each other, provide support to the items within the carton 28, and provide a shock absorbing air space between adjacent items. As such, the ribs or divider walls 32 are configured to have a slight draft angle relative to the floor 14. The draft angle $\mu$, (best seen in FIG. 10) is selected to balance the design requirements of sufficient product contact for support purposes on the one hand, and ease of withdrawing the article 10 from the forming tool and withdrawing the item 16 from the cell 34 on the other hand. It has also been found that the greater the angle $\mu$, the more flexible is the rib 32, and the less resistant it is to shock loading. In the preferred embodiment, the draft angle $\mu$ is in the range of 3 to 45°, and most preferred is a range of 3 to 15°.

Figure 5:
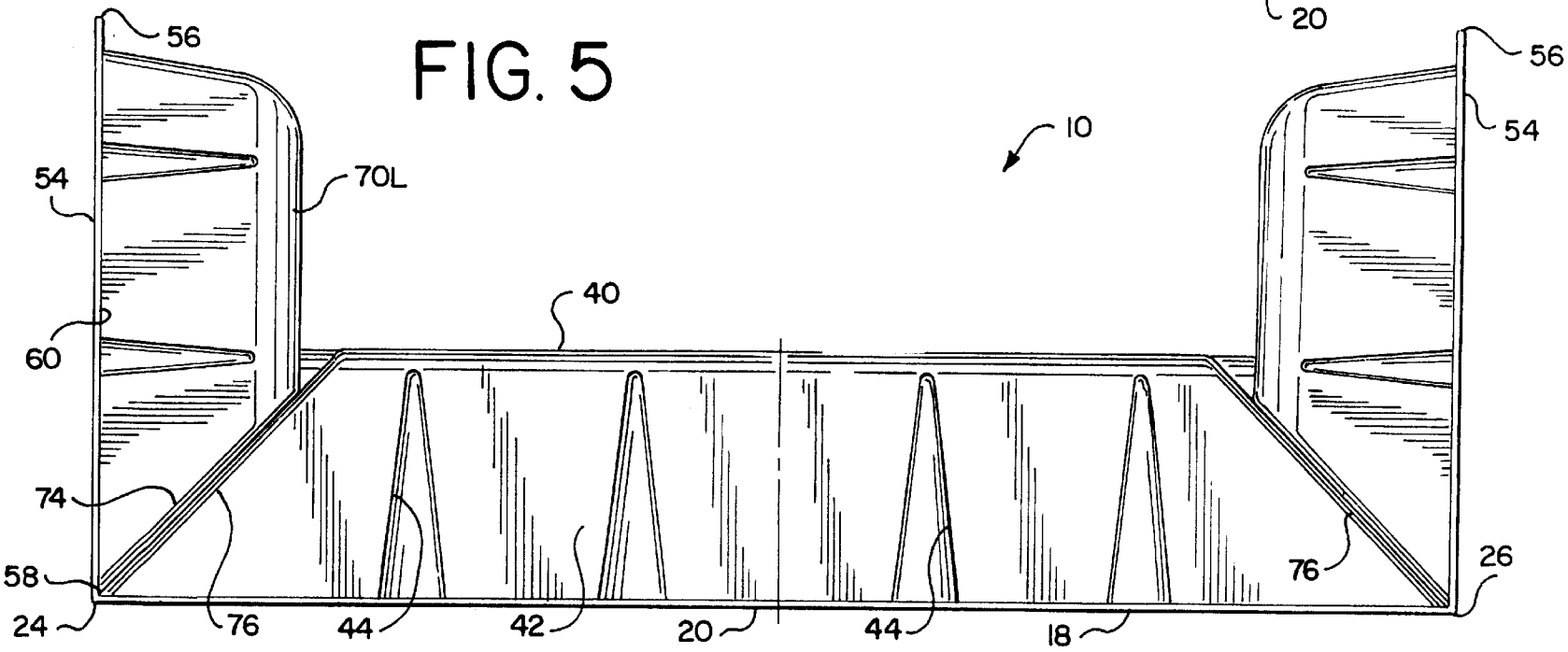
FIG. 5 is a front elevational view of the packaging article of FIG. 3.

In the preferred embodiment of FIGS. 3, 5 and 6 it will be noted that on at least the front and rear edges 20, 22 an outermost rib 40 defines an outer wall or skirt 42. Each skirt 42 terminates at the front and rear edges 20, 22 and the distance between the edge and the top of the rib 40 is greater than the distance between the floor 14 and the same top of the rib. Thus, the floor 14 is maintained in a suspended distance above the edges 20, 22 which engage the corresponding panel 30 of the carton 28.

Figure 4:
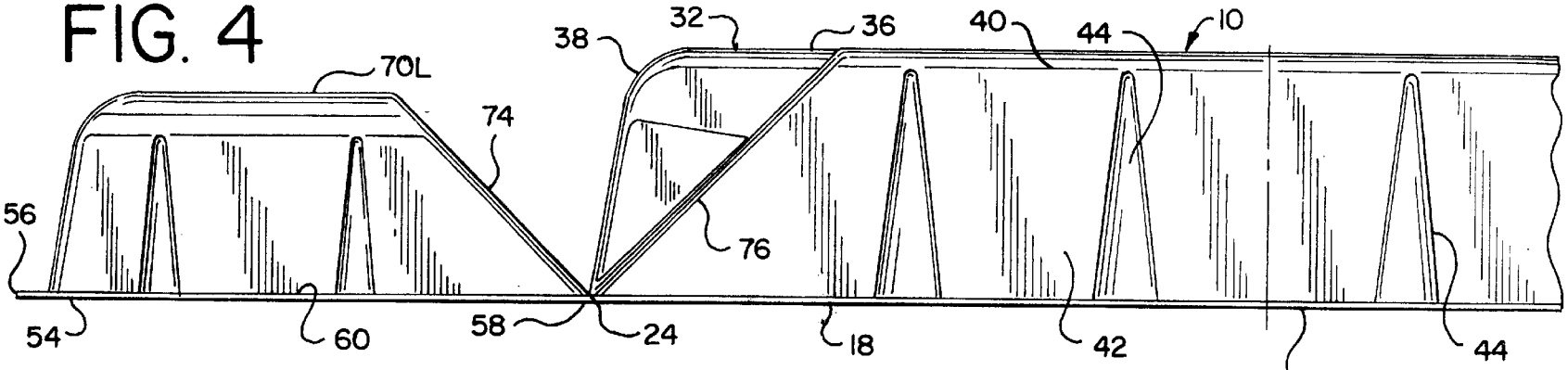
FIG. 4 is a fragmentary front elevational view of the packaging article of FIG. 3 shown with one of its flaps extended.
Figure 7:
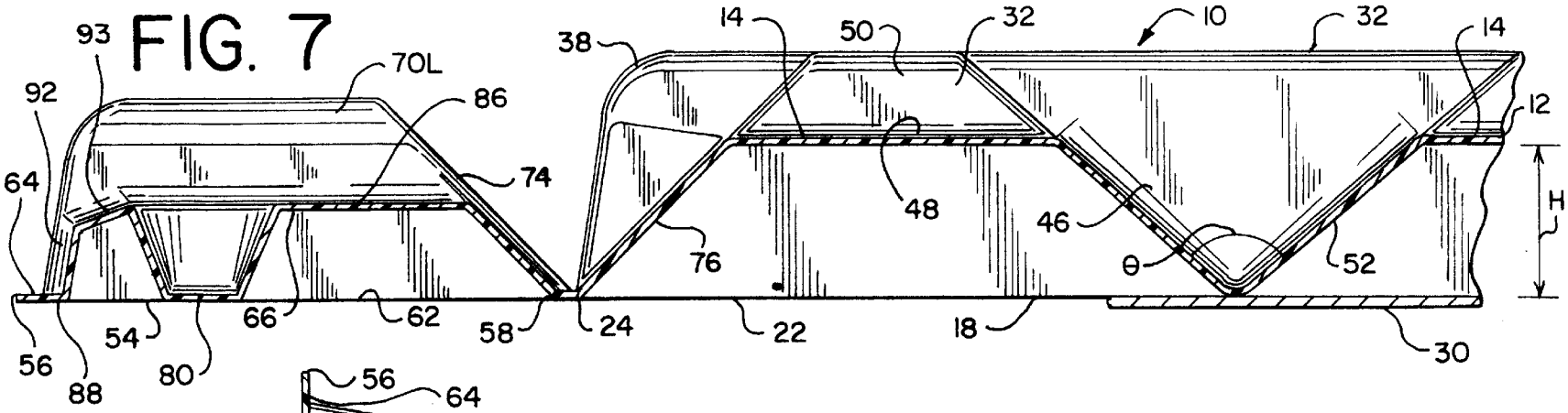
FIG. 7 is a sectional view taken along the line 7—7 of FIG. 6 and in the direction generally indicated.
Figure 8:
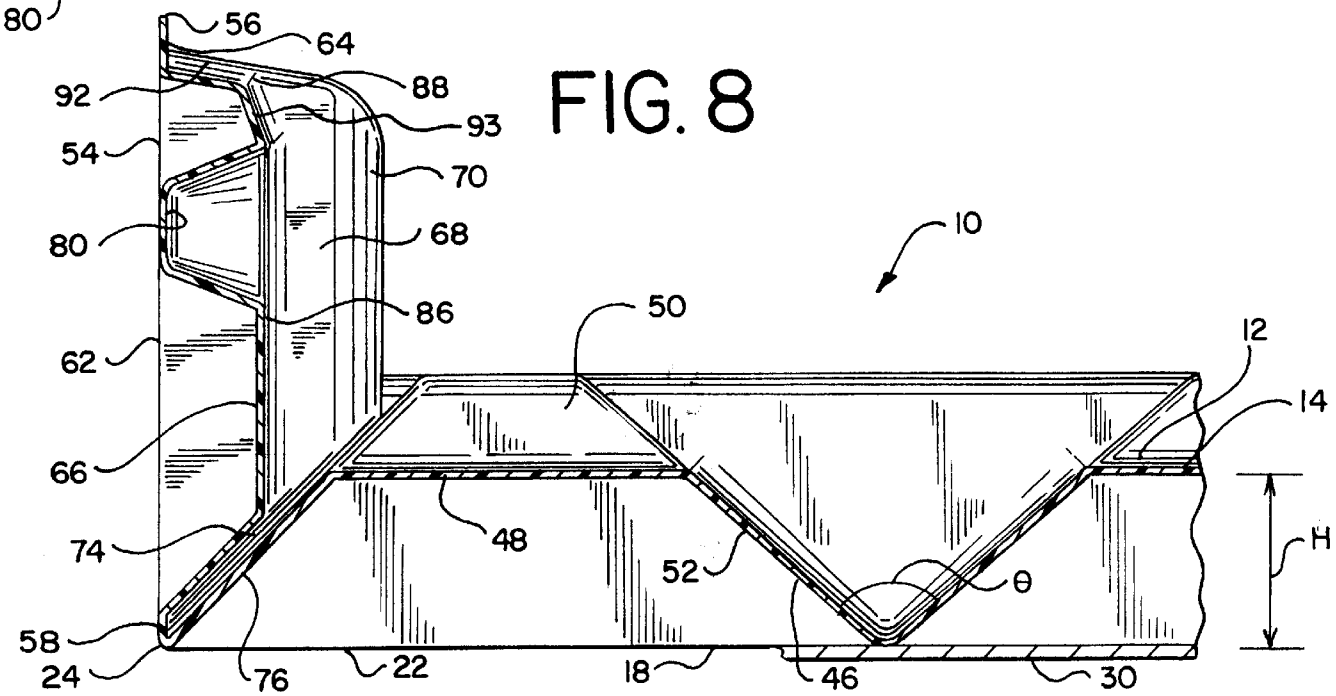
FIG. 8 is a fragmentary sectional view of the packaging article shown in FIG. 7 shown in the assembled position.

Refering now to FIGS. 7 and 8, a shock absorbing or cushioning distance "H" (best seen in FIGS. 7 and 8) is thus defined between the floor 14 and the edges 20, 22, and ultimately, the carton panel 30. It will be appreciated that the skirt 42 need not be so long in all embodiments, and in some cases where such cushioning is not required, the skirt 42 may be the same length as the distance between the floor 14 and the top of the rib 40 (best seen in FIG. 22). Referring now to FIGS. 3–5, in applications where the skirt 42 must have greater rigidity, it is generally provided with at least one and preferably as many as four to six generally "A"-shaped strengthening recesses 44, which are integrally formed with the skirt.

An important feature of the article 10 is that at least one of the cells 34 is provided with at least a portion of a crush depression or crush button 46 for forming or further defining the cushion distance "H" between the floor 14 and an adjacent panel of the carton 28. Generally speaking, crush depressions 46 are formations in the article 10 which define a collapsible shell for protecting the item 16 from shock damage. The structure of the depression 46 is such that it resists compression, and also defines an air space for cushioning purposes between an end of the depression which contacts an adjacent surface or substrate, and the item itself. As will be described in greater detail below, a feature of the present packaging article 10 is that crush depressions may be provided in multiple panels of the article, and in multiple item-supporting cells 34, to the extent where each cell preferably has at least one depression 46, or a portion of a depression.

Referring now to the packaging article 10 depicted in FIGS. 3, 6, 7 and 8, the floor 14 is provided with a row of generally "V"-shaped depressions 46 which are generally centrally located on the main platform 12 and generally parallel to the sides 24, 26. The depressions 46 are of a size and placement such that they each interrupt at least one of the ribs 32, which are oriented at a perpendicular angle to a longitudinal axis of the depressions 46.

It will be seen that the depressions 46 interrupt the floor 14 in the corresponding cells 34 to create floor segments 48. These floor segments 48 are more rigid and provide additional support to the packaged item 16 located in each cell than if the floor was continuous between the side edges 24, 26. In addition, the ribs 32 are separated into rib segments 50 which are more rigid than the full length ribs 32. In the preferred embodiment, a portion of each depression 46 is disposed in at least two different cells, and each depression interrupts at least one rib. However, depending on the type of item to be packaged, by design the cells 34 can provide a range of flexibility by providing depressions 46 in each cell, and also by changing the size of the depressions.

More specifically, the preferred embodiment of the article 10 includes at least one crush depression 46 in each cell 34 defined by the ribs 32, with the exception of the cells adjacent the front and rear edges 20, 22. The V-shaped depressions 46 are formed by a pair of side walls 52 intersecting to define an angle $\theta$ in the order of 20 to 90°. Also, the depressions 46, a portion of each of which is located in a corresponding cell 34, are closed off by being bounded by adjacent ribs 32. In the preferred embodiment, a common rib 32 dividing adjacent cells which contain each depression 46 is segmented by the depression.

Another feature of the present packaging article 10 is that it is provided with a hinged protective flap 54 hingedly secured to each of the side edges 24, 26. Preferably, the flaps 54 are integrally formed with the main platform 12, and are thermoformed from a single sheet of thermoformable material. Once formed, the article 10 defines a generally "U"-shape when viewed from the front or rear. The flaps 54 must be supported in the generally vertical position by some outside force, such as the adjacent panels of the carton 28.

To provide protection to the packaged items 16, the flaps 54 are each provided with an upper edge 56, a lower or hinge edge 58 opposite the upper edge, and front and rear edges 60, 62, respectively. It will be appreciated that the front and rear edges 60, 62 are so designated only for reference in view of the present illustrations, and may be reversed in position to suit the application. Also provided to each of the side flaps 54 is an inner surface 64 for engaging the packaged items 16, and an outer surface 66 for engaging the corresponding panel of the carton 28.

Each flap 54 is preferably divided into a plurality of flap cells 68 by a plurality of flap ribs 70 projecting inwardly from the inner flap surface 64. The flap cells 68 are in registry with the cells 34 of the platform portion 12 to basically extend the latter cells vertically for providing support to the ends of the items 16 contained in each of the cells 34. In the preferred embodiment, the flap ribs alternate between long ribs 70L and short ribs 70S. The long ribs 70L extend from the upper edge 56 to the hinge edge 58, while the short ribs 70S generally extend approximately only half the length of the long ribs, with the difference being taken up by a slot 72 (best seen in FIG. 6). Thus, at the hinged junction of the flap 54 and the platform portion 12, at least one of the flap ribs 70L projects beyond adjacent flap ribs 70S toward the platform portion.

Lower ends 74 of the ribs 70L are inclined to form a 90° angle with a corresponding angled skirt wall 76 located between the main platform 12 and the side edges 24, 26. The purpose of the skirt wall 76 is to continue the skirt 42 around the entire periphery of the article 10 and completely define the cushion space H. To provide structural support for the article 10 once it is placed in the carton 28, the slots 72 create a nesting place for corresponding ends of alternating long ribs 32 on the main platform 12.

Another feature of the present article 10 is that the flap ribs 70 are radiused at their inner and upper edges, and in some cases (best seen in FIG. 11) are also tapered to be thinner at the upper edge 78 than towards the hinge edge 58 of the flap 54. This feature makes it easier for assembly personnel to place the items 16 into the cells 34, 68 once the articles 10 are placed inside the carton 28.

Yet another feature of the present packaging article 10 is that additional crush depressions 80 are supplied to the flaps 54 to provide shock absorption protection to the ends of the packaged items 16. In the preferred embodiment, there is one such depression 80 in each of the flap cells 68, however it is contemplated that more or fewer depressions 80 may be employed depending on the particular application, the type of item and/or the standards of the respective manufacturer.

Figure 9:
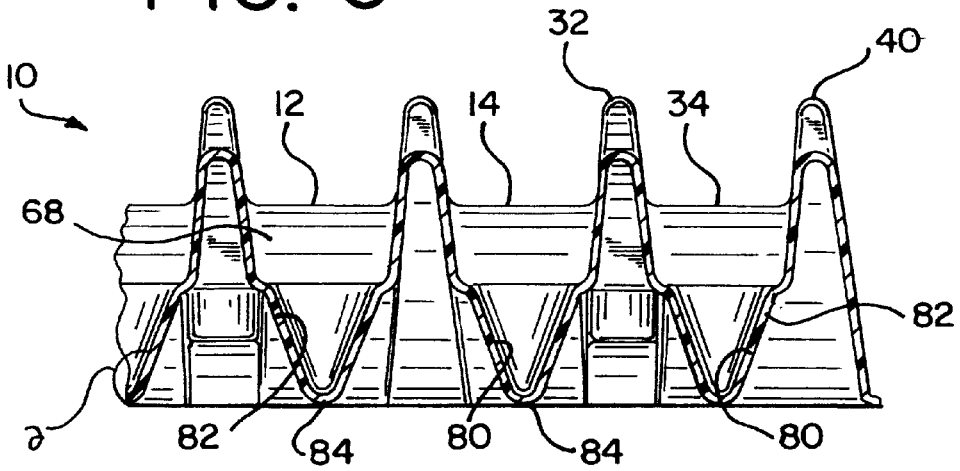
FIG. 9 is a sectional view taken along the line 9—9 of FIG. 6 and in the direction generally indicated.

The depressions 80 vary in shape from the depressions 46, although this too may depend on the particular application. It is preferred that the depressions 80 are generally "V" or "U"-shaped when viewed in vertical cross-section taken with the flaps 54 laying generally coplanar with the main platform 12 and viewed from the front of the article 10 (best seen in FIG. 9). This V or U-shape is defined by a sidewall 82 and a bottom 84. When viewed from the top in that position (best seen in FIG. 6), the depressions are generally rectangular or oval in shape.

It is preferred that the sidewalls 82 of the crish depression 80 have a draft angle δ relative to the bottom 84, and that the angle generally be in the range of 3° to 15°. This draft angle δ facilitates release of the article 10 from the forming tool, and also enhances the shock absorbing characteristics of the depression 80. It has been found that the greater the draft angle, the more likely is the formation, be it crush depression or rib, to flex in response to shock. Conversely, the more vertical the sidewall 82, the more likely it is to be initially stiff, and eventually crumple under drop-type, or axially directed shock loading.

Referring again to the flap cells 68, each of the cells has a cell floor 86, with an upper end 88 and a hinge end 90, in the preferred embodiment, the upper ends 88 are provided with a notch formation 92 which is recessed from the corresponding ends of adjacent flap ribs 70. In addition, the notch formation 92 has an inwardly directed or tapered portion 93 generally beginning at the upper end of the depression 80. This configuration is designed to provide the upper ends of the flaps with additional rigidity and strength, and assists in maintaining the item 16 securely within the cell 34, 68.

Figure 17:
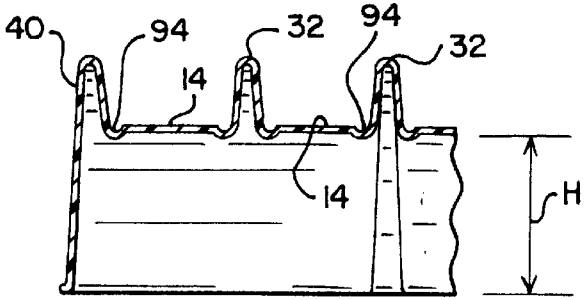
FIG. 17 is a sectional view taken along the line 17—17 of FIG. 14 and in the direction generally indicated.
Figure 18:
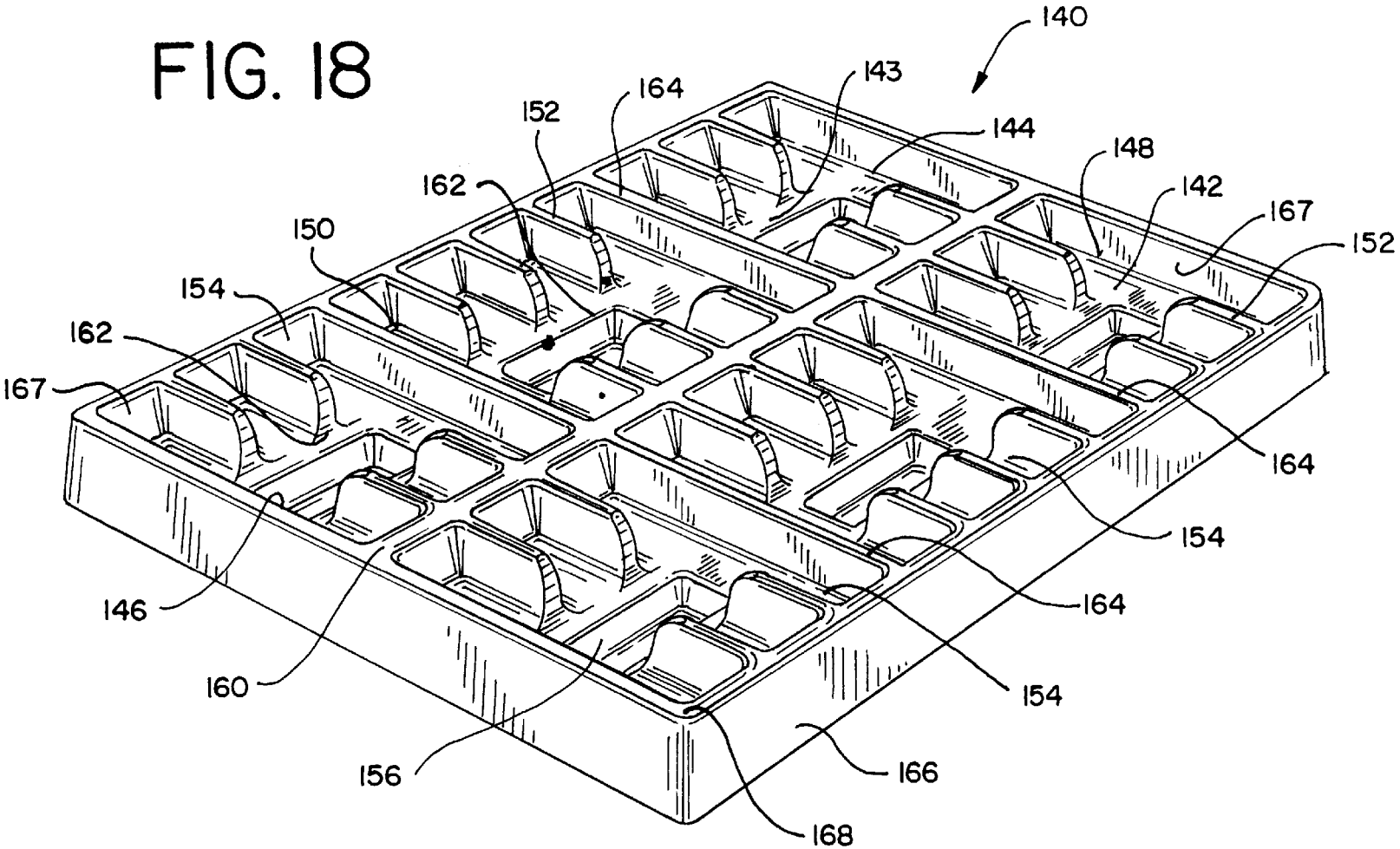
FIG. 18 is a top perspective elevation of a fragility lid incorporating features of the present invention.
Figure 19:
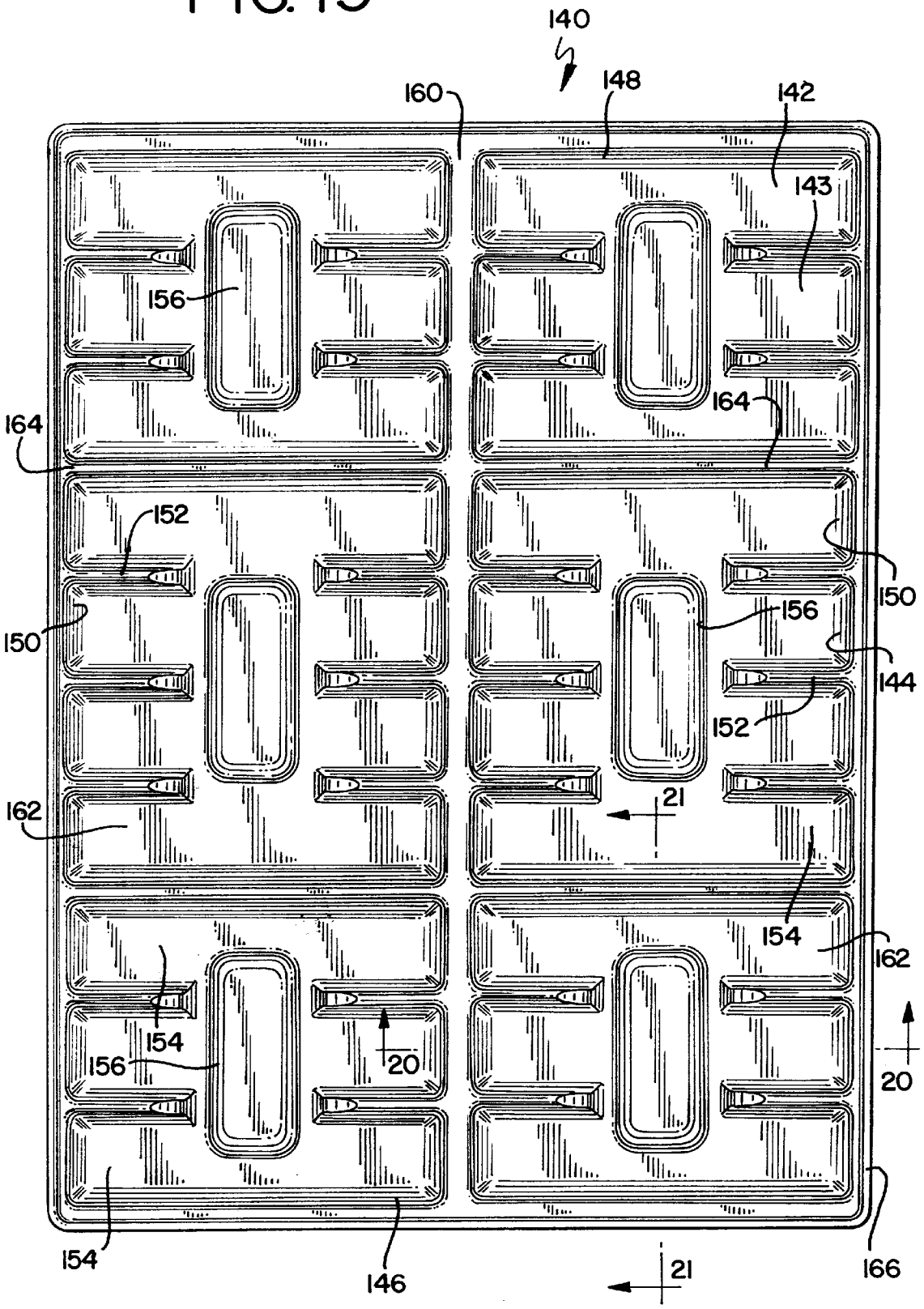
FIG. 19 is an overhead plan view of the lid shown in FIG. 18.

Referring now to FIGS. 6 and 17, yet another feature of the article 10 is that in some applications, at least one of the flap cells 68, and/or at least one of each main platform cell 34, has at least one relatively shallow, elongate trough 94 for increasing the shock absorption characteristics of the cell. Preferably each of the cells 68, 34 has such a trough. The trough 94 is a shallow groove in the flap cell floor 86 and is preferably located either in the center of the cell floor (best seen in FIG. 10), or alternatively at the outer side edges of the floor where they intersect with the flap ribs 70 (best seen in FIGS. 6 and 17).

An advantage of the troughs 94 is that they provide a limited amount of flexibility to the flap cell for additional controlled shock absorption. The troughs 94 thus provide, on a smaller scale, cushioning properties which are similar in principle to those provided by the elongated skirt 42 and the cushion distance H. It has also been found that the troughs 94 provide a deflection path for the flap cell floor 86 when subjected to loading forces. In this manner, the remainder of the floor 86 is not distorted or misshapen upon shock loading.

Figure 10A:
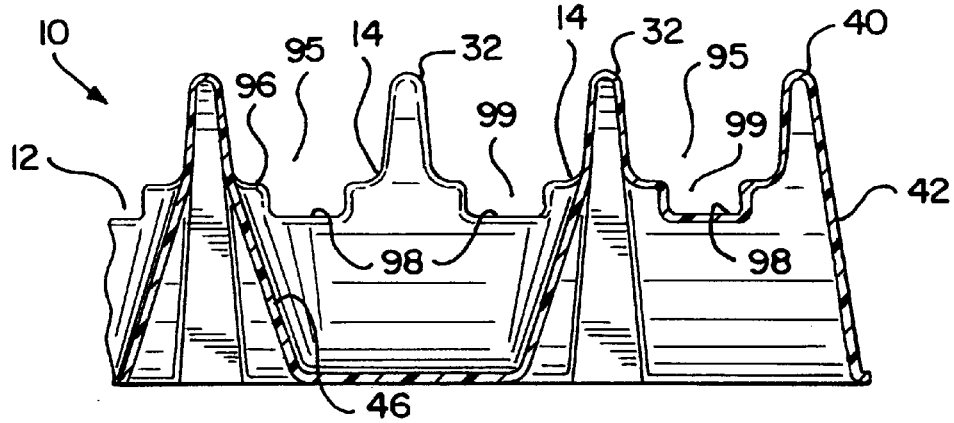
FIG. 10*a* is a fragmentary sectional view of the structure shown in FIG. 10 depicting an alternate embodiment of the article containing cell configuration.

Referring now to FIG. 10A, an alternate embodiment of the item supporting cell 34 is designated 95 and is depicted in cross-section, in which the floor 14 of at least one of the cells of the platform portion 12 is provided with a main floor portion 96 and a recessed floor portion 98 for accommodating fragile items 16 of different sizes. Thus, a first wider or thicker item may be secured in the cell upon the floor portion 96, and alternatively, a relatively narrower item 16 may be secured in the cell 34 and be supported upon the recessed floor portion 98. In this manner, a single configuration of the fragility packaging article 10 incorporating this feature may be used for more than one type and/or size of packaged item, thus reducing the variety of the inventory to be held by a manufacturer, and by a packaging supplier. It is of course contemplated that the size and depth of a recession 99 defined by the recessed floor portion 98 may vary with the application.

Figure 11:
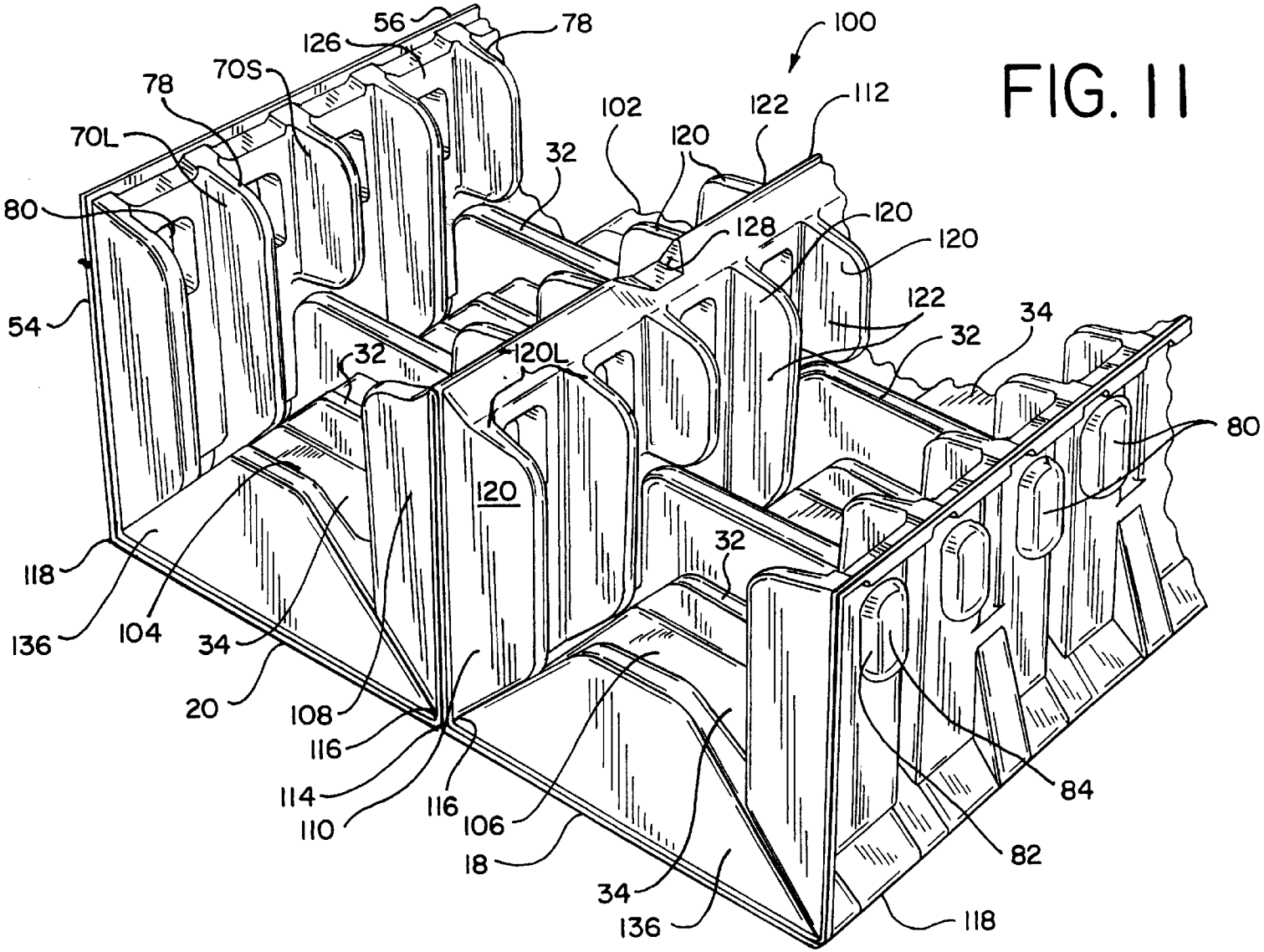
FIG. 11 is a fragrnentary top perspective view of an alternate embodiment of the present fragility packaging article.

Referring now to FIG. 11, another embodiment of the packaging article 10 is generally designated 100. Features common to the articles 100 and 10 have been designated with the same reference numbers, and both articles are preferably made of the same types of plastic materials in the same way. The main distinguishing feature of the article 100 is that its main platform 102 is actually divided into two, generally parallel platforms, 104, 106 by an integral pair of inner sidewalls 108, 110. Each of the inner sidewalls 108, 110 has a corresponding upper edge 112 and a hinged lower edge 114 by which it is integrally joined to the respective main platform 104, 106.

The main purpose for the distinguishable configuration of the article 100 is for securing two rows of a smaller item 16 than is packaged in the article 10. In this manner, the capacity of a particular carton 28 to retain fragile items 16 is doubled. Further, the items 16 packaged in the carton 28 using the packaging article 100 will receive the same degree of protection as the items packaged in the article 10. That is because virtually every one of the features described above regarding the article 10 may also be provided to the article 100.

More specifically, and referring to FIGS. 11–16, each of the platform portions 104, 106 have a peripheral edge 18 including generally parallel front and rear edges 20, 22 (best seen in FIGS. 15 and 16) and generally parallel inner and outer side edges 116, 118. The lower edges 114 of the inner sidewalls 108, 110 are integrally formed into a hinge joint with the respective inner side edges 116 of the corresponding platform portions 104, 106 to position the inner sidewalls in a back-to-back orientation, shown in FIG. 11. It will be seen that the upper edges 112 of the sidewalls 108, 110 are also integrally joined to each other in a hinged relationship, so that the article 100 may preferably be thermoformed from a single sheet of thermoformable material, as is the article 10.

In similar fashion to the article 10, the article 100 includes a plurality of ribs 32 which divide the main platforms 104, 106 into main item-supporting cells 34. One feature of the ribs 32 as used in the article 100 is that each rib, when viewed in vertical cross-section, is tapered or narrowed toward an upper end thereof to facilitate the loading of a packaged item into the corresponding cell. Further, the inner sidewalls 108, 110 are also preferably provided with a plurality of sidewall ribs 120 disposed on each sidewall to project from the sidewalls and to form sidewall cells 122 in a way which further defines the item supporting cells 34. Thus, the sidewall ribs 120 are in registry or are aligned with the ribs 32, as well as with the flap ribs 70. A feature shared with the flaps 54 is that the inner sidewalls 108, 110 in at least one of the cells are each preferably provided with at least a portion of a crush depression 80. In the depicted embodiment in FIG. 11, each sidewall cell 122 is provided with a crush depression 80.

As is the case with the flap ribs 70, the sidewall ribs 120 are tapered in cross-section toward their upper ends 124. Also, each adjacent pair of the sidewall ribs 120 defines a sidewall cell floor 126 having an upper end and an opposite hinge end, each said sidewall cell floor being tapered toward the upper end to facilitate the insertion of fragile items 16 into the cell. It is also contemplated that upper ends of the sidewall cell floors 126 each define a notch 128 (only one shown for clarity). The notch 128 will add strength and rigidity to the back-to-back sidewalls 108, 110, for applications where that property is desired. In the alternative, or in addition to the notch 128, the upper ends of the floors 126 may be tapered toward the upper end to facilitate the insertion of fragile items into said cell. This latter configuration is preferable for applications in which rapid loading of the items 16 into the articles 10, 100 is a key design factor. The tapered or inclined cell floors 126 make it easier to rapidly locate the item 16 in the appropriate position for insertion into the cell.

Another feature shared by the flaps 54 and the inner sidewalls 108, 110 is the provision of at least one trough 94 (best seen in FIG. 14) in at least one of the cells 122 for the same reasons of controlled flexibility as those features are provided in the cells 34, and 68. In FIG. 17, the troughs 94 are shown located at the intersection of the floor 14 and the ribs 32, however other locations are contemplated, including in the middle of the floor 126 (corresponding structure seen in FIG. 10).

The sidewall ribs 120 are also divided into alternating short ribs 120S and long ribs 120L, so that the short ribs 120S can receive relatively longer main platform ribs 130 (best seen in FIG. 12), to form a more rigid package once the article 100 is placed in a suitable carton 28 (best seen in FIG. 2). It will be seen from FIG. 11 that the alternating relationship of the ribs 120S, 120L need not be regular, in that near the front and rear edges 20, 22 are provided a pair of longer ribs 120L which are adjacent each other (best seen in FIG. 11).

Figure 12:
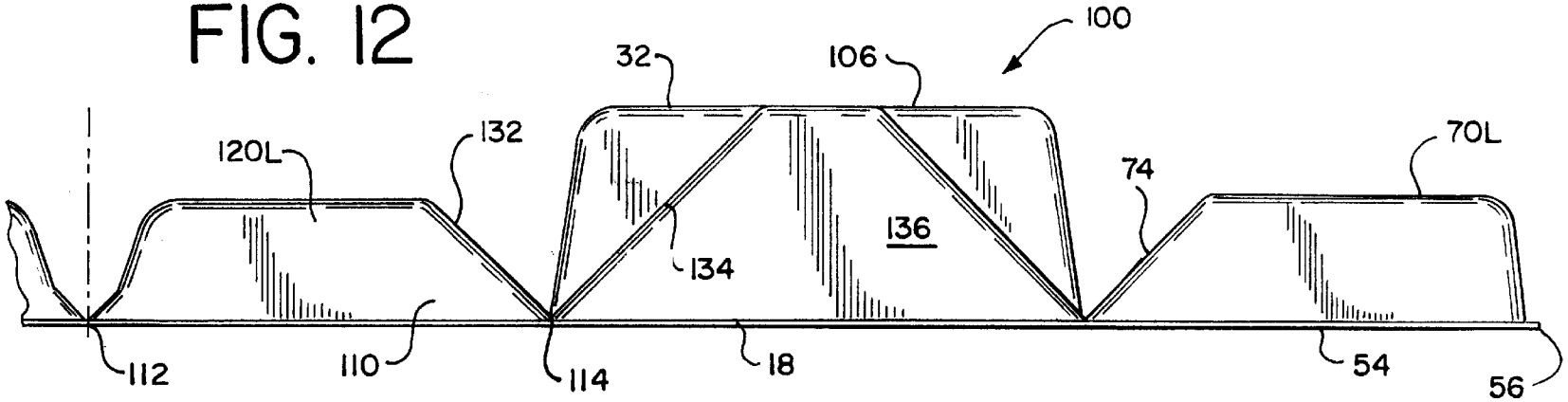
FIG. 12 is a fragmentary front elevational view of the article of FIG. 11 with flaps and inner sidewalls extended.
Figure 13:
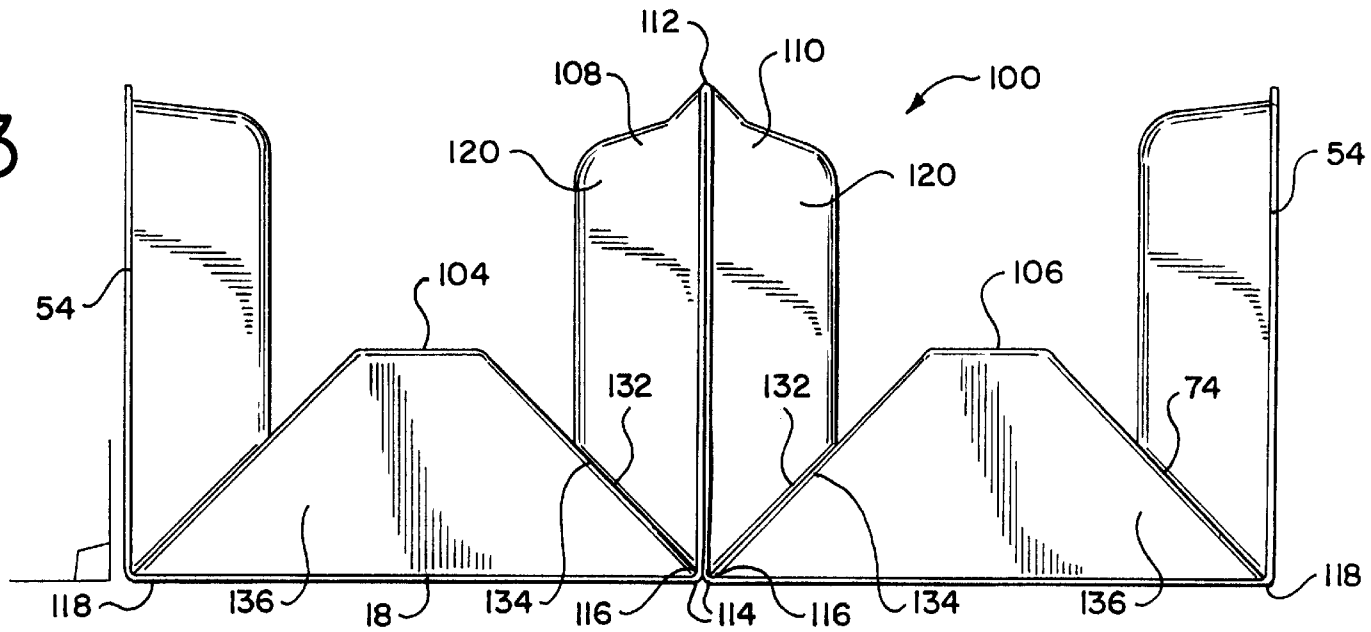
FIG. 13 is a front elevational view of the packaging article shown in FIG. 11.
Figure 14:
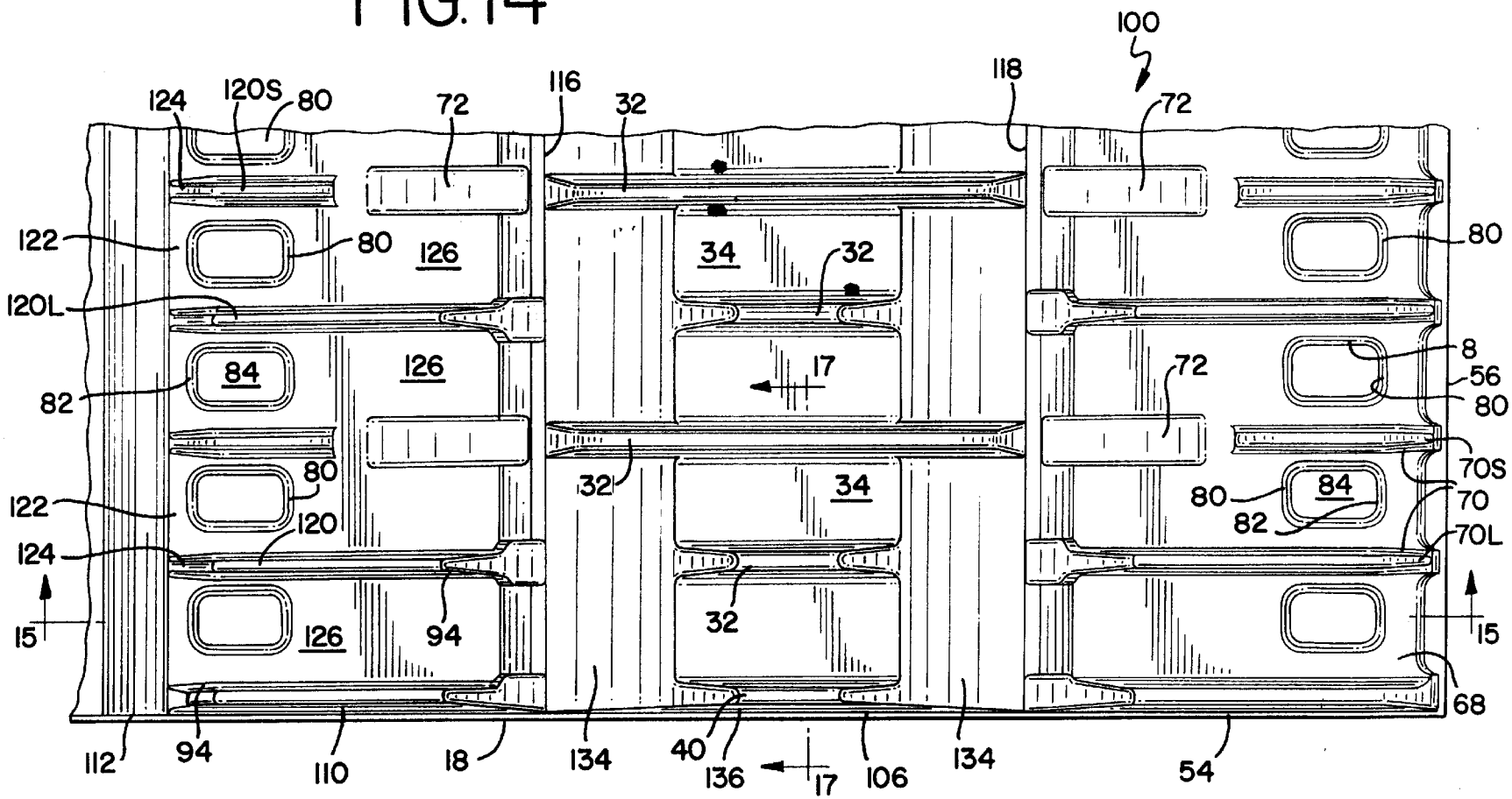
FIG. 14 is a fragmentary overhead plan view of the packaging article shown in FIG. 12.
Figure 15:
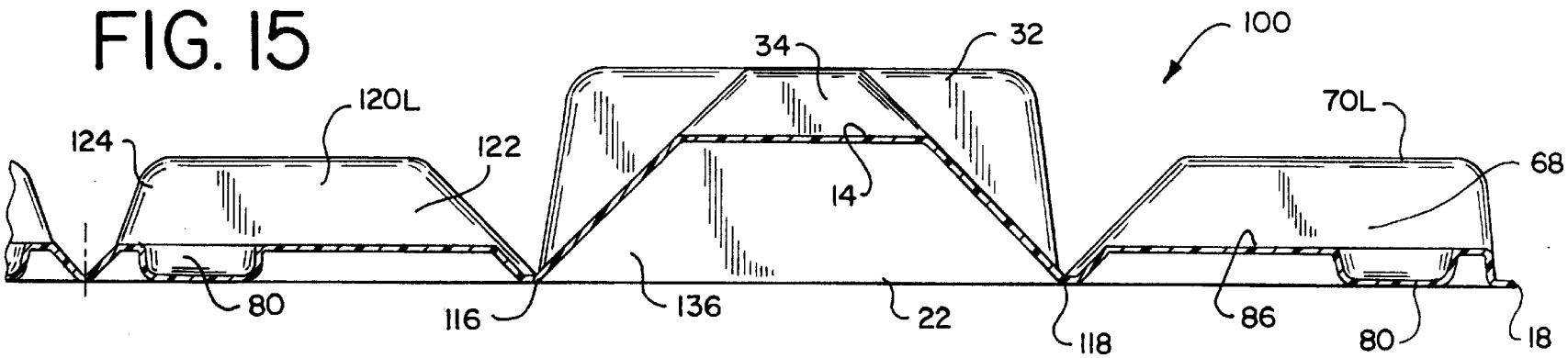
FIG. 15 is a sectional view taken along the line 15—15 of FIG. 14 and in the direction generally indicated.
Figure 16:
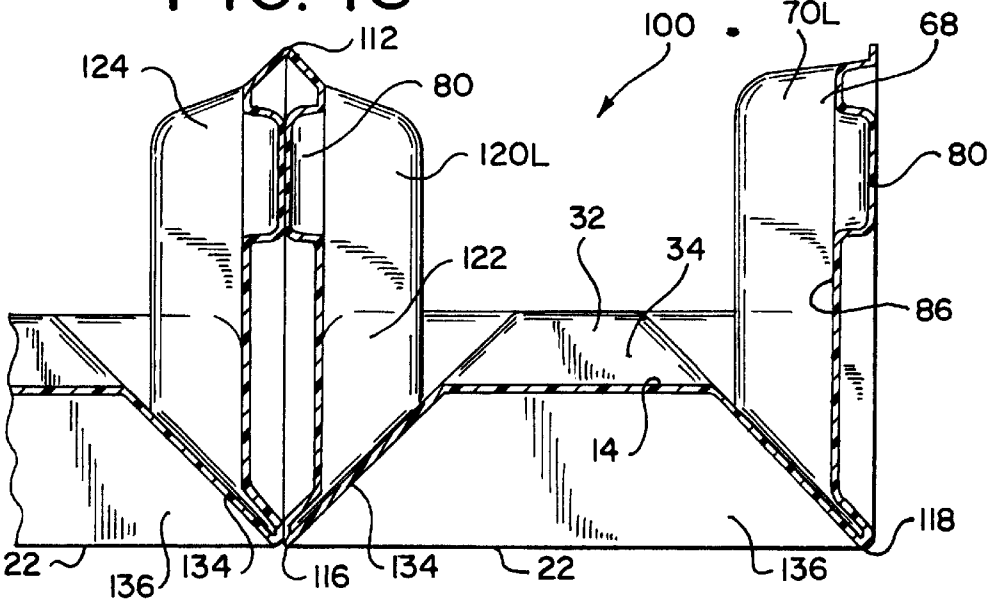
FIG. 16 is a vertical cross-section of the package of FIG. 15 shown in the assembled position.

Referring now to FIGS. 2, 12 and 13, it will be seen that the longer sidewall ribs 120L have a base portion 132 extending beyond the base of the ribs 120S toward the corresponding platform portion 104, 106 to contact an angled skirt wall 134, which corresponds to the angled wall 76 of the article 10 (best seen in FIG. 4). The result is a mitered joint which forms a 90° angle for added strength (best seen in FIG. 13). Similarly, the shorter sidewall ribs 120S are each shortened to make room for a slot 72 for receiving a corresponding end of each of the longer ribs 32. Also, the article 100 may also be provided with a pair of protective flaps 54 integrally formed and hingedly secured along each of the corresponding outer side edges 118. The flaps 54 are preferably identical to the flaps 54 described in relation to the article 10. In addition to the angled skirt wall 134, the article 100 also preferably has a front and rear skirt wall 136 which, in combination with the wall 134, defines a cushion distance "H" (best seen in FIGS. 15 and 16) between the platforms 104, 106 and the adjacent panels of the carton 28, in similar fashion to the article 10.

It is also contemplated, however, that the wall 136 may be shortened to the extent that the wall is the same length as the rib 32, so that no cushion distance "H" is defined. In such cases, the vertical shock loading protection, if any, is provided by the crush depressions 46 (See FIG. 22).

Referring now to FIGS. 18–21, another embodiment of the present packaging article is illustrated and is generally designated 140. The article 140 as illustrated is intended for use as a lid in conjunction with one of the articles 10, 100, or other fragility packaging article which engages three panels of the carton 28 as depicted in FIG. 1. If desired, the lid 140 may be integrally formed with either of the articles 10 and 100 along one edge (best seen in FIG. 2) to provide a unitary packaging article which provides fragility protection on four sides of the packaged item, and corresponding to the top, bottom and two sides of the carton 28. Alternatively, the lid 140 may be provided in two portions, with one edge of each portion integrally joined to a corresponding edge of the article 10, 100.

Thus, the purpose of the article 140 as illustrated is to provide shock absorbing protection to the tops of the packaged items 16. However, it is contemplated that, depending on the application, the structure 140 may be used as a base for protecting items, or it may be provided with hinged flaps 54 as described and depicted in relation to the packaging articles 10 and 100.

As depicted, the packaging article 140 is preferably made of the same plastic material and in the same way as are the articles 10 and 100, and is a unitary article including a platform 142 defining a floor 143 for supporting at least a portion of the item 16. A peripheral edge 144, generally parallel front and rear edges 146, 148 and generally parallel side edges 150 are all provided to the floor 143. The designation "front" and "rear" for the edges 146, 148 is only for description purposes, since the article 140 is symmetrical and may be oriented in the reverse direction and appear the same.

A plurality of ribs 152 are disposed on the platform portion 142 to project from, and to divide the floor 143 into a plurality of article-supporting lid cells 154 which are oriented generally parallel to the front and rear edges 146, 148, and generally perpendicular to the side edges 150.

A plurality of crush depressions 156 are provided in the floor 143 for forming a cushion distance between the floor and an adjacent panel of the container 28. The crush depressions 156 are preferably rectangular when viewed from above (best seen in FIG. 19) in order to generally traverse several lid cells 154. Also, the preferred configuration of the crush depressions 156 is generally "U"-shaped in vertical cross section (best seen in FIG. 20) with drafted sidewalls 158 having a similar configuration to the crush depressions 80 described above. Each depression 156 also has a bottom 159. In the preferred embodiment, each of the crush depressions 156 is disposed transversely in at least two of the lid cells 154 to interrupt the ribs 152 in some of the cells 154. It will be appreciated that the number, orientation and configuration of the depressions 156 is presently illustrated for purposes of example only and may change as needed to suit a particular application and/or a manufacturer's specifications. Thus, while the ribs 152 may be shown separated by the depressions 156, it is contemplated that in some cases, the ribs 152 may extend the entire width of the article 140.

A center rib 160 is disposed transverse to the plurality of lid ribs 152 ribs and is generally centrally located between the side edges 150. As such, in the preferred embodiment the center rib 160 divides the floor 143 into two equally sized portions, which in the preferred embodiment correspond to the first and second platforms 104, 106 of the packaging article 100 (best seen in FIG. 2). The center rib 160 also is important for providing additional structural rigidity to the article 140.

In combination, the presence of the center rib 160 and the elongate crush depressions 156 define a plurality of square or rectangular spaces 162 which are separated from each other in a direction transverse to the center rib 160 by undivided or longer lid ribs 164. This structure also adds rigidity to the article 140. Also provided to the article 140 is an outer peripheral wall 166 defining a skirt which preferably extends below the level of the floor 143 (best seen in FIGS. 20 and 21) to define a cushion distance "H" as described above in relation to the embodiments 10 and 100. An inner peripheral wall 167 and a peripheral bridge or rim 168 integrally join the outer wall 166 to the floor 143. In the preferred embodiment, both the center rib 160 and the inner peripheral wall 167 are drafted as described above, each defining an angle $\mu$ relative to the floor 143 (best seen in FIG. 22) as described above in relation to FIG. 10.

Figures 20, 21, 22:
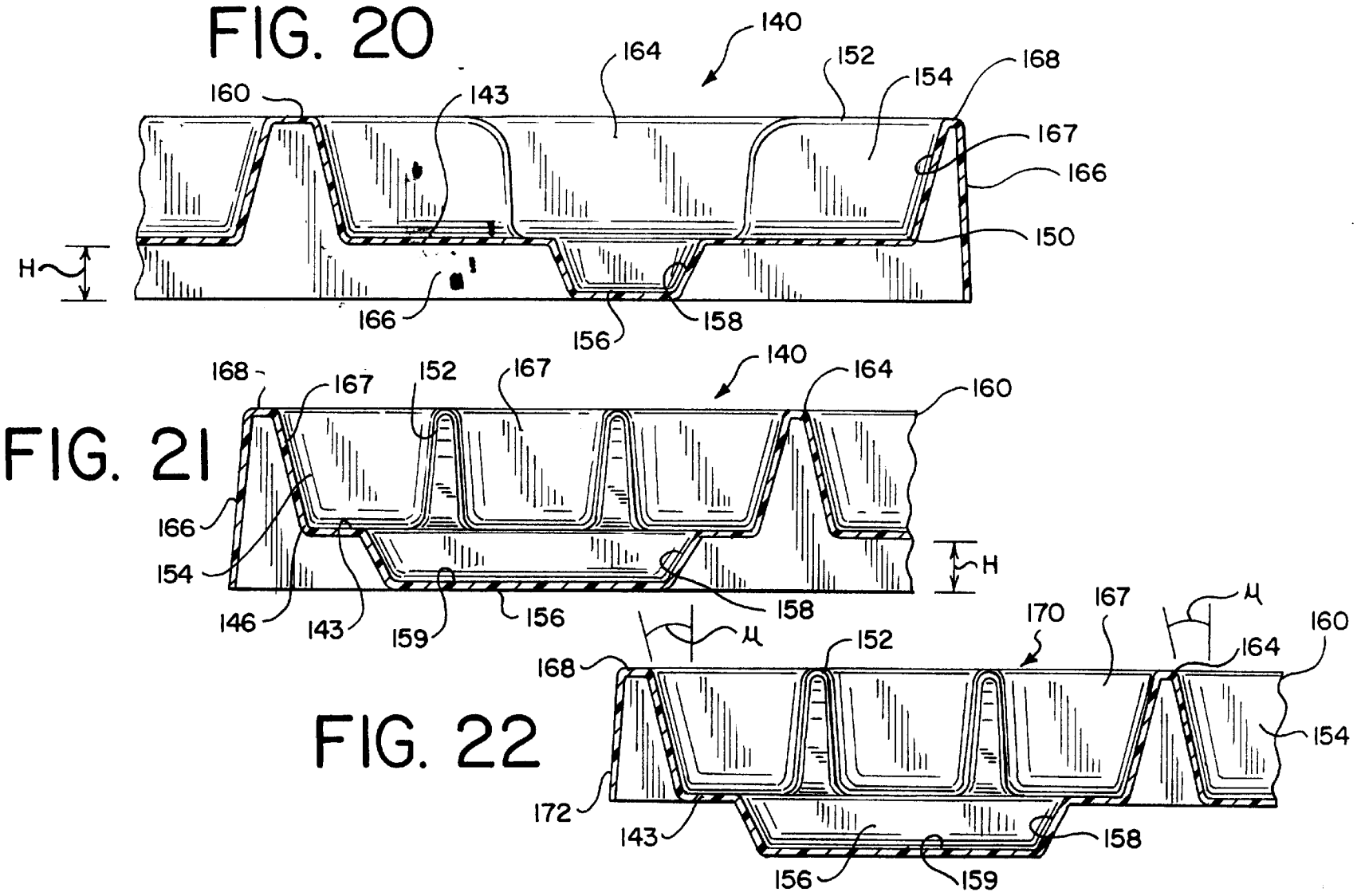
FIG. 20 is a sectional view taken along the line 20—20 of FIG. 19 and in the direction generally indicated.
FIG. 21 is a sectional view taken along the line 21—21 of FIG. 19 and in the direction generally indicated.
FIG. 22 is a fragmentary vertical cross-section of an alternate embodiment to the lid shown in FIG. 20.

Referring now to FIG. 22, an alternative to the article 140 is depicted and generally designated 170, in which corresponding features are designated with identical reference numbers. In fact, the article 170 is identical to the article 140, with the exception that the outer skirt wall 172 is shortened relative to the height of the floor 143 to be approximately equal in length to the inner peripheral wall 167 so that there is no cushion distance "H" defined for vertically directed shock resistance. As described above, it is contemplated that the articles 10 and 100 may also be manufactured in this configuration, with the vertical shock loading resistance, if any, being provided by the crush depressions 46, 156. This type of package is preferred in situations where the item 16 is more resilient, where other vertical shock loading protection is provided, or where the article is designed for in-factory use on pallets where vertical shock loading is not a significant problem. Such construction is also desirable from a forming/cost reduction standpoint.

Figure 23:
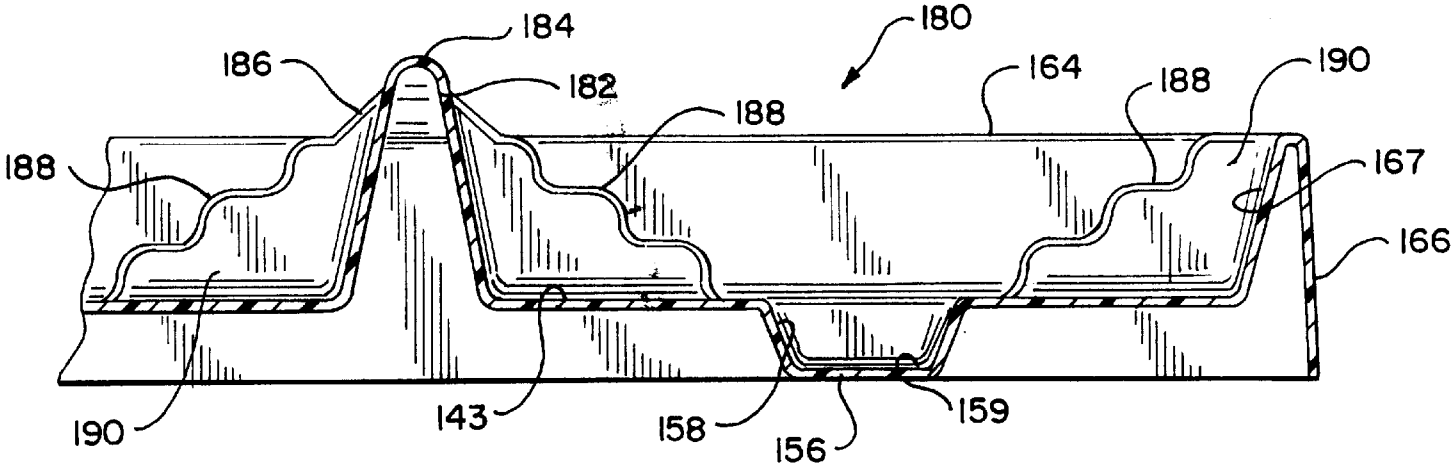
FIG. 23 is a fragmentary vertical cross-section of an alternate embodiment to the lid shown in FIG. 20.
Figure 24:
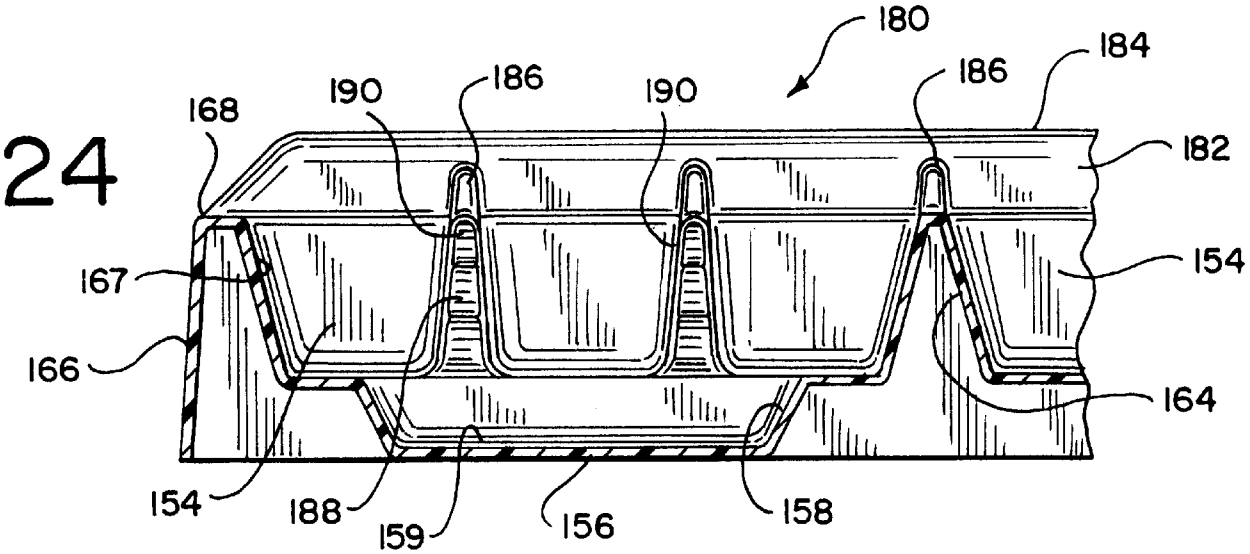
FIG. 24 is a fragmentary vertical cross-section of an alternate embodiment to the lid of FIG. 23 taken from a section similar to that shown in FIG. 21.

Referring now to FIGS. 23 and 24, another alternate embodiment to the packaging article 140 is generally designated 180. Identical features relative to the embodiment 140 have been designated with identical reference numbers. The packaging article 180 differs from the article 140 in two areas, the construction of the center rib (160 in the article 140), and in the configuration of the ribs (lid ribs 152 in the article 140). In the article 180, the center rib 182 extends above a plane defmed by upper ends of the other lid ribs 190, and has a gently radiused apex 184. Support for this relatively enlarged rib is provided by a plurality of gussets 186 which extend along each side of the rib 182 from midway up the center rib 182 to upper ends of the adjacent lid ribs 190. Both the center rib 182 and the gussets 186 are preferably integrally formed with the article 180.

Another feature of the article 180, and one, like the enlarged center rib 182, which could optionally be provided to the article 140, is that separated ends 188 of the lid ribs 190 may be provided with a stepped setback configuration to add rigidity, since the shorter such a wall is, and the more "breaks" or interruptions in the wall, the more rigid it becomes. Another benefit of such a shape is that in some cases, the packaged item may be more easily removed from the cell 154.

Referring now to FIG. 2, an assembled combination of the articles 100 and the lid 140 is shown in a container 28 and with fragile items 16 shown in the appropriate cells 34, 68, 154. Once assembled in the container, the various structures of the articles 100, 140 will selectively provide rigidity, flexibility and shock absorption as desired.

Thus, in its many embodiments, the present packaging article provides many features which may be employed in a variety of combinations to provide customized fragility packaging to accommodate almost any conceivable design requirement, or manufacturer's specification. Depending on the application, the relative rigidity of the ribs, the cell floor, the flaps, the sidewalls, the lid and the skirt may be adjusted.

While a particular embodiment of the improved thermoformed fragility packaging of the invention has been shown and described, it will be appreciated by those skilled in the art that changes and modifications may be made thereto without departing from the invention in its broader aspects and as set forth in the following claims.

We claim:

1. A unitary fragility packaging article for retaining a plurality of shock sensitive items, said article being configured for placement with the items within a container having multiple panels, comprising:

a platform portion defining a floor for supporting at least a portion of the items and having a peripheral edge including generally parallel front and rear edges and generally parallel side edges;

at least one of said front and rear edges of said platform portion is provided with a peripheral wall defined by an inner surface joined to said floor, an outer surface having a lower edge, and a bridge portion for joining corresponding upper ends of said inner surface to said outer surface, wherein said inner surface and said outer surface both extend in a direction generally transverse to said floor and said outer surface is taller than said inner surface so that when the article is placed upon a substrate or against a panel of the container, said floor is suspended above the substrate or panel to define a first air cushioning space;

a plurality of ribs disposed on said platform portion to project from said floor, and to divide said floor into a plurality of item-supporting cells, each said cell configured for receiving one of the items, said ribs project above a plane defined by said floor to separate items located in adjacent cells and provide a shock absorbing air space between adjacent items; and at least one of said cells being provided with at least a portion of a crush depression depending from said floor to define a second air cushioning space between the plane defined by said floor and a plane defined by an adjacent panel of the container upon which said article is disposed, said first and second air cushioning spaces being configured to protect against shock forces generated in the same direction.

2. The packaging article as defined in claim 1 wherein said plurality of ribs are disposed generally parallel to said front and rear edges and each said crash depression is defined between a pair of said fibs.

3. The packaging article as defined in claim 1 wherein said plurality of ribs are disposed generally parallel to said front and rear edges and at least one of said ribs is interrupted by a corresponding one of said at least one crush depression.

4. The packaging article as defined in claim 3 wherein said platform portion includes a plurality of crush depressions extending generally parallel to said side edges, a portion of each said depression being disposed in at least two different cells, and each said depression interrupting at least one of said ribs.

5. The packaging article as defined in claim 4 further including a central rib disposed in a parallel orientation to said side edges and generally perpendicular to said plurality of ribs.

6. The packaging article as defined in claim 5 wherein said plurality of ribs have a generally common, coplanar height, said central rib projects above said plurality of ribs, has a first and a second side and is supported by at least one gusset on at least one of said sides.

7. The packaging article as defined in claim 3 wherein separated ends of said separated ribs have a stepped configuration.

8. The packaging article as defined in claim 1 wherein each said rib, when viewed in vertical cross-section, is tapered or narrowed toward an upper end thereof.

9. The packaging article as defined in claim 1 wherein said floor includes at least one crush depression in each said cell.

10. The packaging article as defined in claim 1 wherein said crush depressions are V-shaped.

11. The packaging article as defined in claim 10 wherein said V-shaped crush depressions are each located within a corresponding cell, are bounded by adjacent ribs, and divide said floor in said cell into first and second floor segments.

12. The packaging article as defined in claim 10 wherein said V-shaped crush depressions are each located within a pair of adjacent cells, said depression dividing said floor in said cells into floor segments, and a common rib of said plurality of ribs being segmented by said depression.

13. The packaging article as defined in claim 10 wherein said V-shaped crush depressions are formed by a pair of side walls defining an angle in the order of 20° to 90°.

14. The packaging article as defined in claim 1 wherein said crash depressions are generally U-shaped, said U-shape being defined by a pair of sidewalls and a bottom.

15. The packaging article as defined in claim 14 wherein each said sidewall and said corresponding bottom define an angle in the range of 3° to 15°.

16. The packaging article as defined in claim 1 wherein at least one of said cells has at least one trough for increasing the shock absorbing characteristics of the cell.

17. The packaging article as defined in claim 16 further including a pair of said troughs, one located at each intersection of said floor in said cell and said ribs.

18. The packaging article as defined in claim 1 further including a protective flap hingedly secured along each of said side edges of said platform portion.

19. The packaging article as defined in claim 18 wherein said flaps are each divided into a plurality of flap cells by a plurality of flap ribs projecting inwardly from said flap, said cells of said flaps being in registry with said cells of said platform portion.

20. The packaging article as defined in claim 18 wherein said flaps have a crush depression in at least one of said flap cells.

21. The packaging article as defined in claim 18, wherein each said flap rib has an upper end corresponding to an upper edge of said flap opposite the hinged connection to said platform portion, said upper end of said flap rib being tapered.

22. The packaging article as defined in claim 21 wherein at the hinged junction of said flap and said platform portion, at least one of said flap ribs projects beyond adjacent flap ribs toward said platform portion.

23. The packaging article as defined in claim 18 wherein each of said flap cells has a cell floor, with an upper end and a hinge end, said cell floor being tapered toward said upper end to facilitate the insertion of fragile items into said cell.

24. The packaging article as defined in claim 18 wherein each of said flap cells has a floor, with an upper end and a hinge end, said floor defining a notch at said upper end.

25. The packaging article as defined in claim 18 wherein each of said flap cells has at least one trough for increasing the shock absorption characteristics of said cell.

26. The packaging article as defined in claim 25 wherein said platform portion has at least one trough in each said cell, and said placement and number of troughs in said platform cells corresponds to said placement and number of troughs in said adjacent flap cells.

27. The packaging article as defined in claim 18 further including at least a portion of a lid joined along a corresponding edge of at least one of said flaps.

28. The packaging article as defined in claim 18 further including a central rib disposed in parallel orientation to said side edges and generally perpendicular to said plurality of ribs, said central rib projecting above said plurality of ribs.

29. The packaging article as defined in claim 1 wherein said floor of at least one cell of said platform portion is provided with a main floor portion and a recessed floor portion for accommodating fragile articles of different sizes.

30. The packaging article as defined in claim 1 wherein said peripheral wall extends around the entire periphery of said platform portion.

31. The packaging article as defined in claim 1 wherein said outer surface is taller than said inner surface so that when the article is placed against a panel of the container, said floor is displaced from the plane defined by the panel.

32. The packaging article as defined in claim 31 wherein said outer surface has at least one strengthening recess.

33. A unity fragility packaging article for retaining a plurality of shock sensitive items, said article being configured for placement with the items within a container having multiple panels, comprising:

a platform portion defining a floor for supporting at least a portion of the items and having a peripheral edge including generally parallel front and rear edges and generally parallel side edges;

at least one of said front and rear edges of said platform portion is provided with a peripheral wall defined by an inner surface joined to said floor, an outer surface having a lower edge, and a bridge portion for joining corresponding upper ends of said inner surface to said outer surface, wherein said inner surface and said outer surface both extend in a direction generally transverse to said floor and said outer surface is taller than said inner surface so that when the article is placed upon a substrate or against a panel of the container, said floor is suspended above the substrate or panel to define a first air cushioning space;

a plurality of ribs disposed on said platform portion to project from said floor, and to divide said floor into a plurality of item-supporting cells, each cell configured for receiving one of the items, said ribs project above a plane defined by said floor to separate items located in adjacent cells and provide a shock absorbing air space between adjacent items;

at least one of said cells being provided with at least a portion of a platform crush depression depending from said floor definig a second air cushioning space between the plane defined by said floor and a plane defined by an adjacent panel of the container upon which said article is disposed, said first and second air cushioning spaces being configured to protect against shock forces generated in the same direction, said crush depressions being constructed and arranged to divide said corresponding cells into floor segments having at least one separated rib;

a protective flap hingedly secured along each of said side edges of said platform portion, each said flap divided into a plurality of flap cells by a plurality of flap ribs projecting inwardly from said flap, said cells of said flaps being in registry with said cells of said platform portion;

said flaps have a crush depression in at least one of said flap cells;

each said flap rib has an upper end corresponding to an outer edge of said flap opposite the hinged connection to said platform portion, said upper end of said flap rib being tapered; and each of said flap cells has a cell floor, with an upper end and a hinge end, said floor being tapered toward said upper end to facilitate the insertion of the fragile items into said cell.

* * * * *

UNITED STATES PATENT AND TRADEMARK OFFICE

CERTIFICATE OF CORRECTION

PATENT NO. : 6,010,007
DATED : April 4, 2000
INVENTOR(S) : Cross

It is certified that error appears in the above-identified patent and that said Letters Patent is hereby corrected as shown below:

Claim 2,
Line 2, delete "crash" and insert -- crush -- therefor
Line 4, delete "fibs" and insert -- ribs -- therefor Claim 14,
Line 2, delete "crash" and insert -- crush -- therefor Claim 33,
Line 30, delete "definig" and insert -- defining -- therefor Signed and Sealed this Twentieth Day of November, 2001

*Attest:*

Nicholas P. Godici

*Attesting Officer*

NICHOLAS P. GODICI
*Acting Director of the United States Patent and Trademark Office*